US009275590B2

(12) United States Patent
Kim et al.

(10) Patent No.: US 9,275,590 B2
(45) Date of Patent: Mar. 1, 2016

(54) LIQUID CRYSTAL DISPLAY AND DRIVING METHOD CAPABLE OF ADAPTIVELY CHANGING A PROBLEM PATTERN

(75) Inventors: Youngho Kim, Paju-si (KR); Suhyuk Jang, Daegu (KR); Songjae Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 460 days.

(21) Appl. No.: 12/588,404

(22) Filed: Oct. 14, 2009

(65) Prior Publication Data

US 2010/0164985 A1 Jul. 1, 2010

(30) Foreign Application Priority Data

Dec. 26, 2008 (KR) ..... 10-2008-0134147

(51) Int. Cl.
*G09G 3/36* (2006.01)

(52) U.S. Cl.
CPC ..... *G09G 3/3614* (2013.01); *G09G 2320/0204* (2013.01)

(58) Field of Classification Search
CPC ..... G09G 3/3614; G09G 2300/0823; G09G 2310/0254; G09G 2320/0693
USPC ..... 345/54, 79, 96, 209
See application file for complete search history.

(56) References Cited

U.S. PATENT DOCUMENTS 7,027,025 B2 * 4/2006 Takeda ..... 345/96
8,723,899 B2 * 5/2014 Kim et al. ..... 345/691
2004/0021625 A1 * 2/2004 Lee ..... 345/87
2004/0070581 A1 * 4/2004 Hiraki et al. ..... 345/209
2004/0178980 A1 * 9/2004 Rao ..... G09G 3/3614 345/96
2005/0012733 A1 * 1/2005 Rao et al. ..... 345/209
2005/0093806 A1 * 5/2005 Hosotani ..... G09G 3/2092 345/96
2005/0259067 A1 * 11/2005 Cheng ..... G09G 3/3614 345/103
2006/0007093 A1 * 1/2006 La ..... 345/96
2006/0028426 A1 * 2/2006 Hiratsuka ..... G09G 3/3614 345/103
2006/0097967 A1 * 5/2006 Lee ..... 345/87
2006/0114220 A1 * 6/2006 Wang ..... 345/103
2006/0262055 A1 * 11/2006 Takahara ..... 345/81
2007/0109245 A1 * 5/2007 Hwang ..... 345/98

(Continued)

FOREIGN PATENT DOCUMENTS

JP 8-202317 A 8/1996
JP 11-95725 A 4/1999

(Continued)

*Primary Examiner* — Chanh Nguyen
*Assistant Examiner* — Navin Lingaraju
(74) *Attorney, Agent, or Firm* — Dentons US LLP

(57) ABSTRACT

A liquid crystal display and a driving method thereof are provided. The liquid crystal display includes a liquid crystal display panel, a register for storing pixel information of a problem pattern and polarity pattern information, a block pattern recognition unit for comparing input data with the problem pattern to count the number of problem patterns contained in the input data and comparing the count value with a first threshold value, a line pattern recognition unit for determining the line containing the problem pattern as a problem line, a frame pattern recognition unit for comparing the number of problem lines with a second threshold value, and determining the frame containing the input data as a problem frame, a polarity control signal generating unit for generating vertical and horizontal polarity control signals, and source drive integrated circuits (ICs) for controlling the vertical and horizontal polarities of data voltages supplied to the data lines.

15 Claims, 10 Drawing Sheets

(56) References Cited

U.S. PATENT DOCUMENTS

| | | | | |
|---|---|---|---|---|
| 2008/0001869 | A1* | 1/2008 | Chung et al. | 345/87 |
| 2008/0001890 | A1* | 1/2008 | Song et al. | 345/96 |
| 2008/0204444 | A1* | 8/2008 | Ryu et al. | 345/214 |
| 2008/0297451 | A1* | 12/2008 | Marcu | 345/77 |
| 2009/0122054 | A1* | 5/2009 | Lee et al. | 345/214 |
| 2009/0251451 | A1* | 10/2009 | Cha et al. | 345/211 |
| 2010/0033413 | A1* | 2/2010 | Song et al. | 345/89 |

FOREIGN PATENT DOCUMENTS

| | | | |
|---|---|---|---|
| JP | 2000-235375 | A | 8/2000 |
| JP | 2005-531805 | A | 10/2005 |
| JP | 2006-18103 | A | 1/2006 |
| KR | 20000029282 | A | 5/2000 |
| WO | WO 2007/099673 | A1 | 9/2007 |

* cited by examiner

| BIT location | b7 | b6 | b5 | b4 | b3 | b2 | b1 | b0 |
|---|---|---|---|---|---|---|---|---|
| 1st Register | Vertical POL | | 1st Line Pattern Information | | | | | |
| 2nd Register | ON/OFF | H1 (or) H2DOT | 2nd Line Pattern Information | | | | | |

FIG. 7

1st Line Information

| R1 | G1 | B1 | R2 | G2 | B2 |
|---|---|---|---|---|---|
| 1 | 1 | 1 | 0 | 0 | 0 |

2nd Line Information

| R3 | G3 | B3 | R4 | G4 | B4 |
|---|---|---|---|---|---|
| 0 | 0 | 0 | 1 | 1 | 1 |

FIG. 8

| | | PATTERN1 | | | | | | BIN | DEC | HEX |
|---|---|---|---|---|---|---|---|---|---|---|
| 1 | 1 | 1 | 1 | 1 | 0 | 0 | 0 | 11111000 | 248 | F8 |
| 1 | 1 | 0 | 0 | 0 | 1 | 1 | 1 | 11000111 | 199 | C7 |

| PATTERN1 | | | | | | |
|---|---|---|---|---|---|---|
| 1 | 1 | 1 | 0 | 0 | 0 | 1st Information |
| 0 | 0 | 0 | 1 | 1 | 1 | 2nd Information |

LIQUID CRYSTAL DISPLAY AND DRIVING METHOD CAPABLE OF ADAPTIVELY CHANGING A PROBLEM PATTERN

This application claims the benefit of Korean Patent Application No. 10-2008-134147 filed on Dec. 26, 2008, which is incorporated herein by reference for all purposes as it fully set forth herein.

BACKGROUND OF THE INVENTION

1. Field of the Invention

This document relates to a liquid crystal display and a method for driving the same.

2. Discussion of the Related Art

Flat panel displays include a liquid crystal display (LCD), a field emission display (FED), a plasma display panel (PDP), an organic light emitting display (OLED), etc.

Since the LCD satisfies the trend toward lightweight, thin, short and small electric appliances and has improved mass productivity, cathode ray tubes have been rapidly replaced with LCDs in many applications. An active matrix type LCD which drives liquid crystal cells using thin film transistors (hereinafter, referred to as "TFTs") has been rapidly developed to realize an increase in size and a high resolution by a recent mass production technology and the results of research and development and has been quickly replacing cathode ray tubes in many applications.

A liquid crystal display is driven in an inversion method for inverting the polarities of data voltages charged in a liquid crystal display panel in a predetermined pattern in order to prevent degradation of liquid crystal. However, a data voltage charged in the liquid crystal display panel is biased toward one polarity or another according to the correlation between an image pattern input to the liquid crystal display and a polarity pattern of the liquid crystal display panel, and a common voltage shift is generated due to the biased polarity, thereby degrading display quality.

A pattern of an input image that degrades the display quality in the liquid crystal display may be defined as a problem pattern (or weak pattern), and problem pattern images include an image having white data and black data alternating in subpixels, an image having white data and black data alternating in pixels, a crosstalk check pattern containing a white display surface in a black background, and so on. In addition, the problem pattern includes interlace data in which odd-numbered line data and even-numbered line data are separated.

The present applicant proposed a method for compensating for a biased polarity of a data voltage or a common voltage shift by changing polarity control signals for controlling the polarity of a data voltage charged in a liquid crystal display panel upon input of an image of a problem pattern in Korean Patent Application 10-2007-0052679 (2007 May 30), Korean Patent Application 10-2008-0055419 (2008 Jun. 12), and Korean Patent Application 10-2008-0032638 (2008 Apr. 8). As a result of applying the previously filed applications to a liquid crystal display, degradation of display quality in an image of a problem pattern can be prevented. However, if a pixel array structure of the liquid crystal display panel is changed, the problem pattern image that degrades the display quality of the liquid crystal display panel is also changed. When the problem pattern image is changed due to a change in the pixel array structure, the polarity pattern of the liquid crystal display panel therefore should be changed.

Accordingly, there is a demand for a method which is capable of adaptively changing a problem pattern image, which is defined differently according to a model of a liquid crystal display, and a polarity pattern of a liquid crystal display panel for preventing degradation of the display quality in the problem pattern image. Furthermore, an algorithm and circuit for implementing an adaptive polarity pattern controlling method has to be implemented in a manner that does not require a large-capacity memory.

SUMMARY OF THE INVENTION

Accordingly, the present invention has been made to solve the above-mentioned problems occurring in the prior art, and an aspect of the present invention is to provide a liquid crystal display, which can change a polarity pattern of a liquid crystal display panel adaptively to various problem patterns without using an additional memory, and a method for driving the same.

To achieve the above aspect, there is provided a liquid crystal display according to the present invention, including: a liquid crystal display panel including a plurality of data lines, a plurality of gate lines crossing the data lines, and a plurality of liquid crystal cells; a register for storing pixel information of a problem pattern and polarity pattern information corresponding to the problem pattern; a block pattern recognition unit for comparing input data and the problem pattern to count the number of problem patterns contained in the input data and comparing the counted value with a first threshold value; a line pattern recognition unit for determining the line as a problem line, if the number of problem patterns in one line is greater than the first threshold value; a frame pattern recognition unit for comparing the number of problem lines with a second threshold value, and if the number of the problem lines is greater than the second threshold value, determining the frame containing the input data as a problem frame; a polarity control signal generating unit for generating vertical and horizontal polarity control signals in the problem frame on the basis of the polarity pattern information; and source drive integrated circuits (ICs) for controlling the vertical and horizontal polarities of data voltages supplied to the data lines in response to the vertical and horizontal polarity control signals.

There is provided a method for driving a liquid crystal display according to an exemplary embodiment of the present invention, including: storing pixel information of a problem pattern and polarity pattern information corresponding to the problem pattern; comparing input data and the problem pattern to count the number of problem patterns contained in the input data and comparing the counted value with a first threshold value; if the number of problem patterns in one line is greater than the first threshold value, determining the line as a problem line; comparing the number of problem lines with a second threshold value, and if the number of problem lines is greater than the second threshold value, determining the frame containing the input data as a problem frame; generating vertical and horizontal polarity control signals in the problem frame on the basis of the polarity pattern information; and controlling the vertical and horizontal polarities of data voltages supplied to the data lines in response to the vertical and horizontal polarity control signals.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 7 and 8 are views showing an example of first and second line information of the problem pattern defined in the register;

DETAILED DESCRIPTION OF THE EMBODIMENT

The above and other aspects and features of the present invention will become more apparent by describing exemplary embodiments thereof with reference to the attached drawings.

Hereinafter, an implementation of this document will be described in detail with reference to FIGS. 1 to 11.

Figure 1:
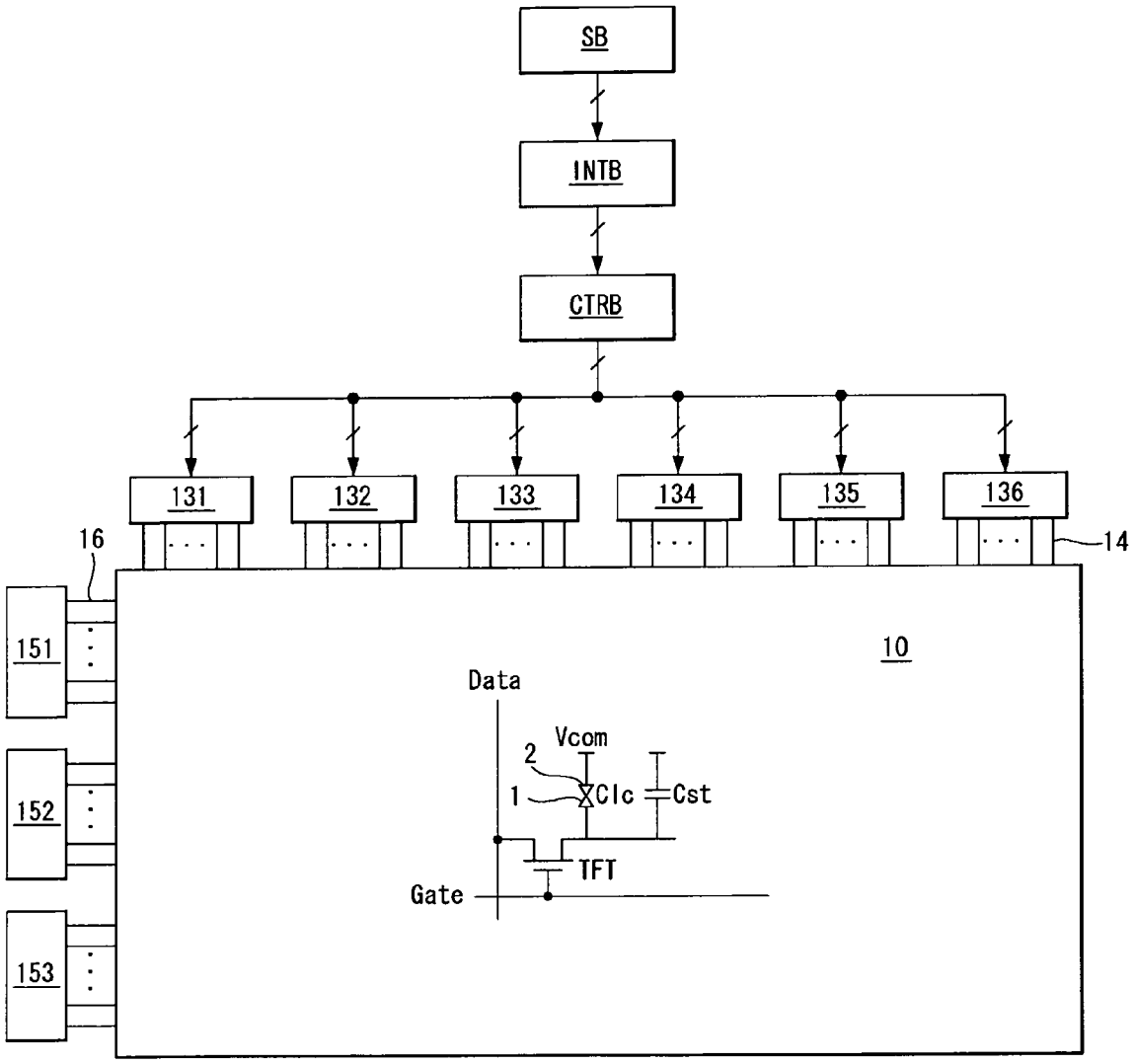
FIG. 1 is a block diagram showing a liquid crystal display according to an exemplary embodiment of the present invention.

Referring to FIG. 1, a liquid crystal display according to an exemplary embodiment of the present invention includes a liquid crystal display panel 10, a plurality of gate drive integrated circuits (ICs) 151 to 153, a plurality of source drive integrated circuits (ICs) 131 to 136, a system board SB, an interface board INTB, and a control board CTRB.

In the liquid crystal display panel 10, a liquid crystal layer is formed between two glass substrates. Liquid crystal cells of the liquid crystal display panel 10 are disposed in a matrix at crossings of data lines 14 and gate lines 16. On the lower glass substrate of the liquid crystal display panel 10, a pixel array including data lines 14, gate lines 16, TFTs, liquid crystal cells Clc connected to the TFTs and driven by an electric field between pixel electrodes 1 and common electrodes 2, storage capacitors Cst, and the like, is formed. Black matrixes, color filters, etc. are formed on the upper glass substrate of the liquid crystal display panel 10. The common electrodes 2 are formed on the upper glass substrate to implement a vertical electric field driving method, such as a twisted nematic (TN) mode or a vertical alignment (VA) mode, and formed on the lower glass substrate together with the pixel electrodes 1 to implement a horizontal electric field driving method, such as an in-plane switching (IPS) mode or a fringe field switching (FFS) mode. Polarizers on which optical axes are perpendicular to each other are attached on the upper and lower glass substrates of the liquid crystal display panel 10, and alignment films are formed at an interface contacting liquid crystal to set a pre-tilt angle for the liquid crystal.

The liquid crystal mode of the liquid crystal display panel 10 applicable in the present invention may be implemented as any liquid crystal mode, as well as the above-stated TN mode, VA mode, IPS mode, and FFS mode. Moreover, the liquid crystal display of the present invention may be implemented in any form including a transmissive liquid crystal display, a semi-transmissive liquid crystal display, and a reflective liquid crystal display. The transmissive liquid crystal display and the semi-transmissive liquid crystal display require a backlight unit which is omitted in the drawings.

The source drive ICs 131 to 136 receive digital video data transmitted by a mini low voltage differential signal (LVDS) method, from the control board CTRB, converts the data into analog data voltages in response to a source timing control signal from the control board CTRB, and supplies the data to the data lines 14 of the liquid crystal display panel 10.

Each of the gate drive ICs 151 to 153 generates a gate pulse (or scan pulse) in response to a gate timing control signal from the control board CTRB and sequentially supplies the gate pulse to the gate lines 16.

The system board SB includes a scaler circuit for adjusting the resolution of the digital video data, and sends timing signals, along with the digital video data, to the interface board INTB. The timing signals include vertical and horizontal synch signals Vsync and Hsync, a data enable signal DE, and a dot clock signal DCLK.

The interface board INTB transmits the digital video data and timing signals input from the system board SB to the control board CTRB via a low-voltage differential signaling (LVDS) interface or a transition minimized differential signaling (TMDS) interface.

The control board CTRB is equipped with a timing controller, a register, an EEPROM (electrically erasable and programmable ROM), etc. The register may be embedded in the timing controller. The register defines a problem pattern and a resultant vertical/horizontal polarity pattern. A LCD maker or TV/monitor set maker may modify, add, and delete the problem pattern and polarity pattern stored in the register via a cable and connector. The timing controller TCON generates a source timing control signal for controlling the operation timing of the source drive ICs 131 to 136 and a gate timing control signal for controlling the operation timing of the gate drive ICs 151 to 153 by using the timing signals received through the interface board INTB.

The source timing control signals include a source start pulse SSP, a source sampling clock SSC, a vertical polarity control signal POL, a horizontal polarity control signal H1/H2DOT, a source output enable signal SOE, etc. The source sampling clock SSC is a clock signal which controls a data sampling operation in the source drive ICs 131 to 136 based on a rising or falling edge. The vertical polarity control signal POL controls the vertical polarity of a data voltage output from the source drive ICs 131 to 136. The horizontal polarity control signal H1/H2DOT controls the horizontal polarity of a data voltage output from the source drive ICs 131 to 136. The source output enable signal SOE controls the output timing of the source drive ICs 131 to 136. If digital video data and a mini LVDS clock are transmitted between the timing controller TCON and the source drive ICs 131 to 136 in accordance with a mini LVDS scheme, a first clock generated after a reset signal of the mini LVDS clock serves as a start pulse. Thus, the source start pulse SSP may be omitted.

The gate timing control signals include a gate start pulse GSP, a gate shift clock signal GSC, a gate output enable signal GOE, etc. The gate start pulse GSP is applied to the first gate drive IC 151 for generating a first gate pulse (or scan pulse). The gate shift clock GSC is commonly input to the gate drive ICs 151 to 153 to shift the gate start pulse GSP. The gate output enable signal GOE controls outputs of the gate drive ICs 151 to 153.

The timing controller TCON compares data of a problem pattern image read out from the register and input data to detect a problem pattern of the input image. Also, the timing controller TCON changes the vertical/horizontal polarity control signals POL and H1/H2DOT into a polarity pattern read out from the register when the input image has a problem pattern. The timing controller TCON changes the vertical/horizontal control signals POL and H1/H2DOT into a predetermined default polarity pattern unless the input image has a problem pattern defined in the register.

Figure 2:
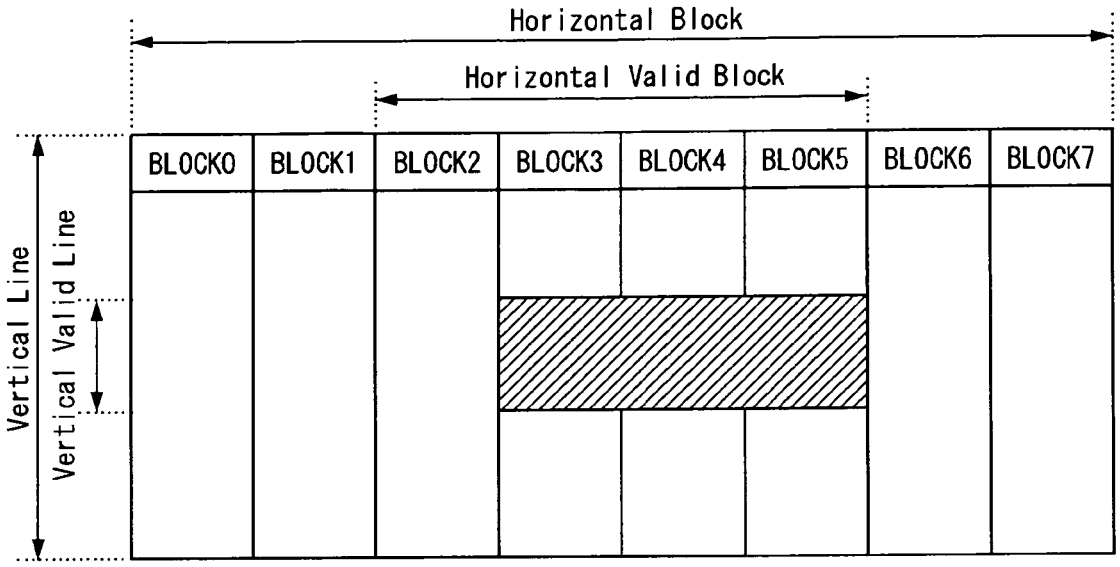
FIG. 2 is a view showing an example in which a display screen of a liquid crystal display panel is virtually divided into a plurality of blocks.

The timing controller TCON virtually divides a display screen of the liquid crystal display panel 10 into a plurality of blocks BLOCKO~BLOCK7 as shown in FIG. 2 without comparing input data of one frame with a problem pattern defined in the register, and detects a problem pattern from the input data by comparing the input data to be displayed on hatched blocks (horizontal valid blocks×vertical valid blocks) with a problem pattern defined in the register.

Figures 3, 4:
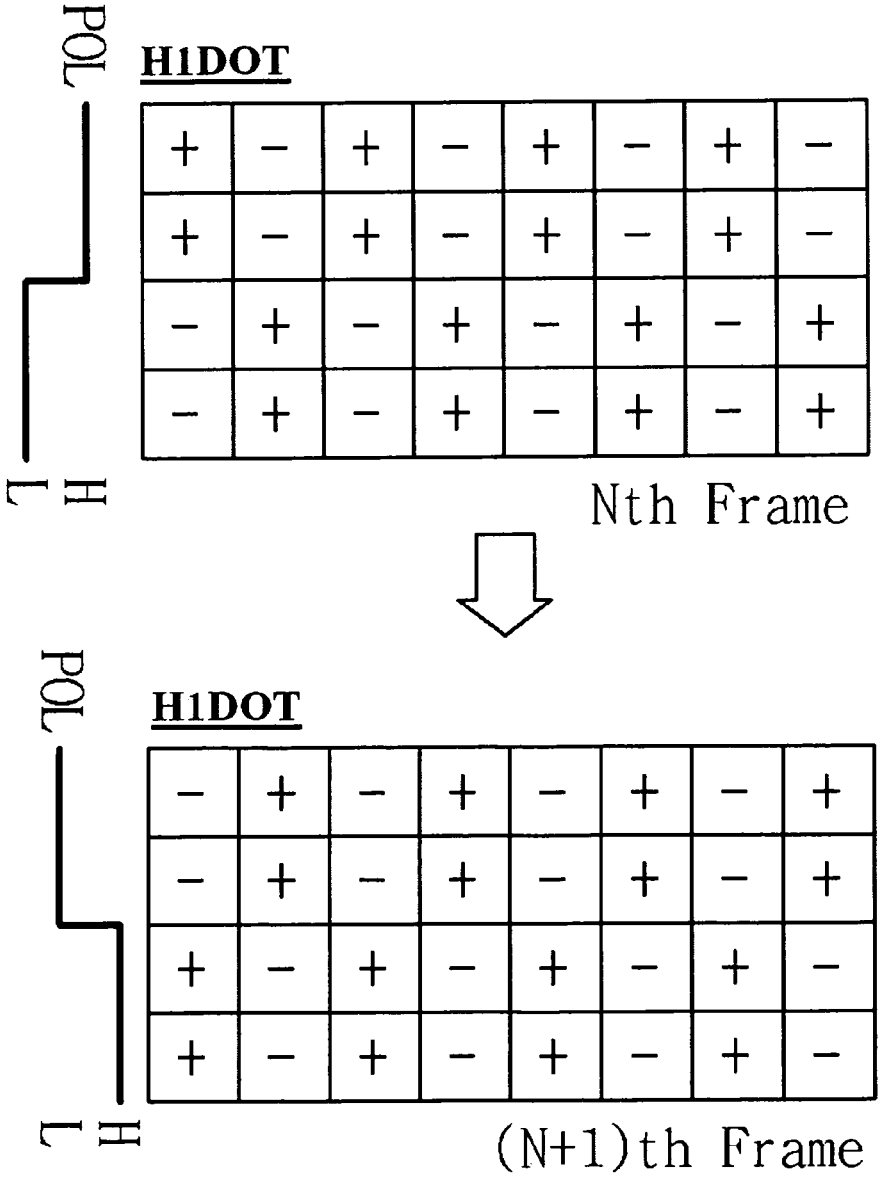
FIG. 3 is a view showing a data mapping table of a register for defining a problem pattern and a polarity pattern.
FIGS. 4 to 6 are views illustrating the polarity of a data voltage controlled according to the polarity pattern shown in FIG. 3.

FIG. 3 is an example of an 8-bit×2 data mapping table of the register for defining a problem pattern and a polarity pattern. The register may define a maximum of 8 problem patterns, and the number of bits per problem pattern allocated to the register is 8-bit×2 as shown in FIG. 3. The register includes a first register of 8 bits and a second register of 8 bits. Vertical polarity control signal information Vertical POL is defined at the b7 to b6 of the first register, and first line information of a problem pattern is defined at the b5 to b0 of the first register. The problem pattern ON/OFF is defined at the b7 of the second register, and the horizontal polarity control signal information H1/H2DOT is defined at b6 of the second register. Second line information of the problem pattern is defined at the b5 to b0 of the second register. When the problem pattern is defined as ON, the timing controller detects a problem pattern from input data by comparing the problem pattern defined in the corresponding register with the input data. On the other hand, when the problem pattern is defined as OFF, the timing controller does not compare the problem pattern defined in the corresponding register with the input data.

Figure 5:
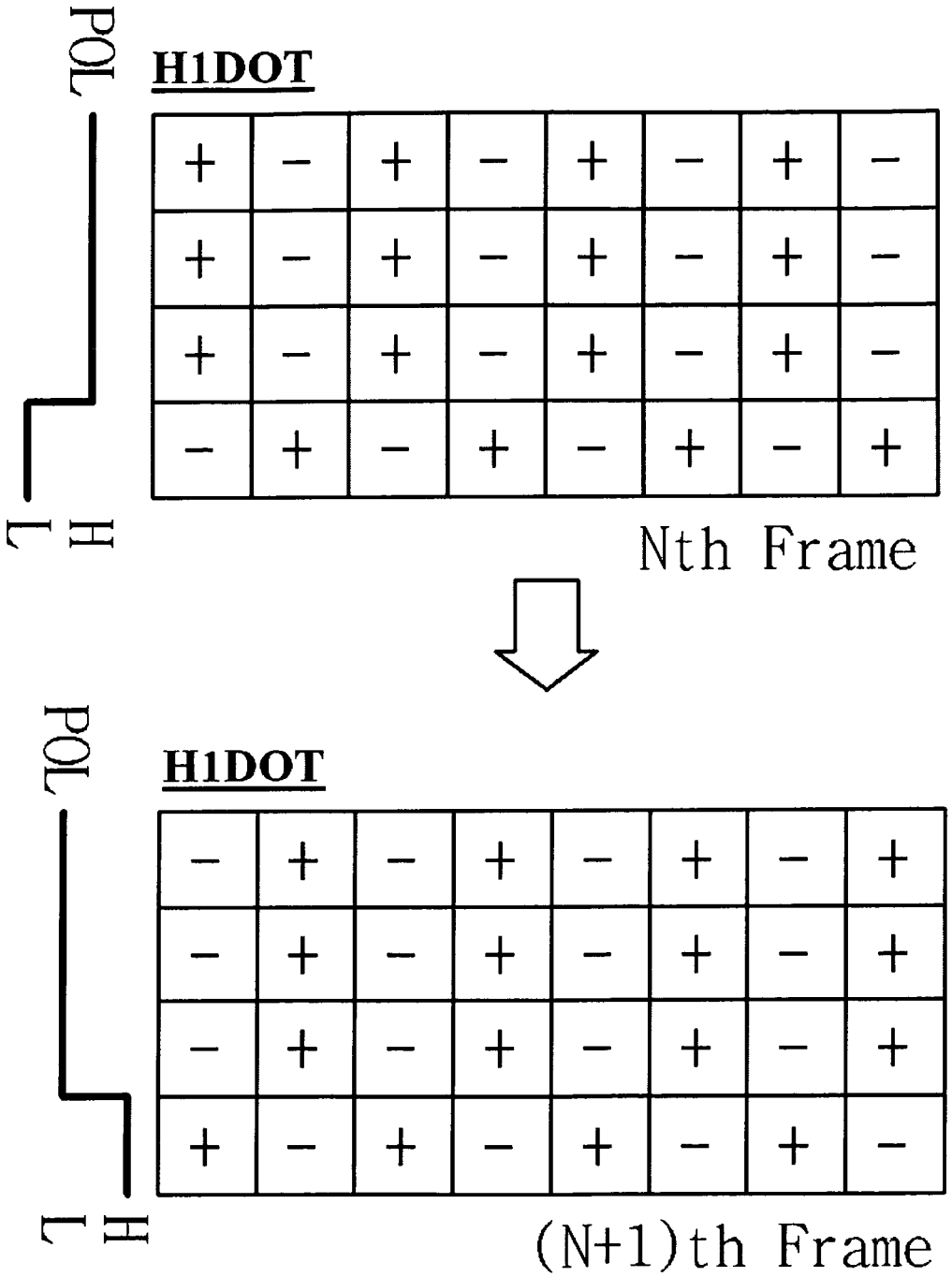
Figure 6:
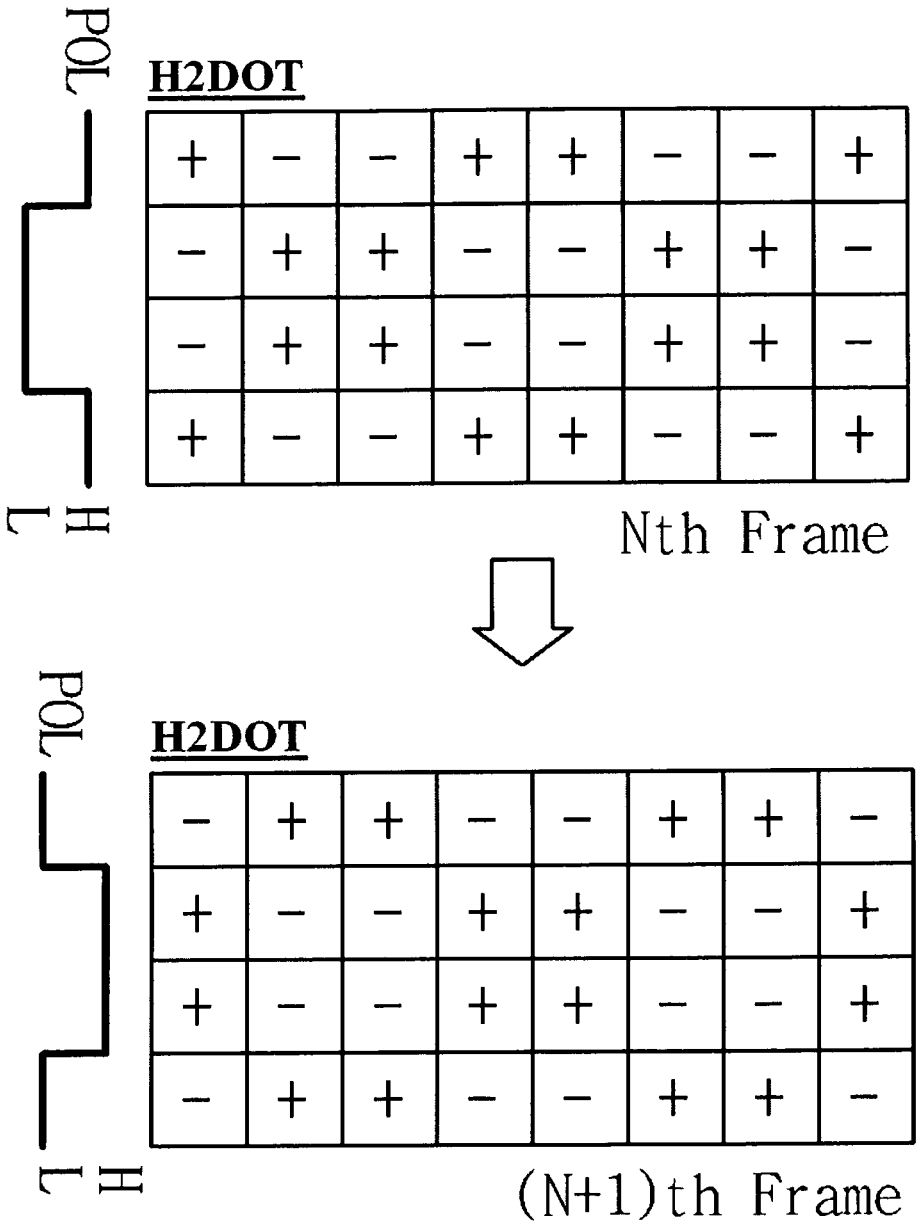

Concrete examples of each category defined in the register are as follows: Vertical POL 00: 1V POL Inversion
01: 2V POL Inversion
10: 3V POL Inversion
11: 6V POL Inversion 'NV' (N is a natural number) represents a vertical polarity control signal POL for changing a logic inversion cycle every N horizontal periods. The source drive ICs 131 to 136 keep the polarity of a data voltage charged in the liquid crystal cells included in a N-number of lines the same for N horizontal periods in response to NV POL, and inverts the polarity of the data voltage every N horizontal periods. FIGS. 4 and 6 show the polarity of a data voltage of liquid crystal cells controlled according to 2V POL, and FIG. 5 shows the polarity of a data voltage of liquid crystal cells controlled according to 3V POL.

Problem Pattern ON/OFF

1: ON
0: OFF

Horizontal Polarity Control Signal Information (H1/H2DOT)

1: H2DOT
0: H1DOT

The source drive ICs 131 to 136 output the data voltages of the same polarity through two adjacent output channels in response to H2DOT and inverts the polarity of the data voltages every two output channels in order to charge the data voltages of the same polarity to two liquid crystal cells, which are horizontally adjacent to each other on the same line in the liquid crystal display panel 10. Also, the source drive ICs 131 to 136 output data voltages of different polarities through adjacent output channels in response to H1DOT in order to charge the data voltages of the opposite polarities to liquid crystal cells, which are horizontally adjacent on the same line in the liquid crystal display panel 10. FIGS. 4 and 5 show the polarity of a data voltage of liquid crystal cells controlled according to H1DOT, and FIG. 6 shows the polarity of a data voltage of liquid crystal cells controlled according to H2DOT.

First and Second Line Information of Problem Pattern

First and second line information of a problem pattern is a pattern of video data which deteriorates the display quality of the liquid crystal display panel. FIGS. 7 and 8 show one example of first and second line information of a problem pattern defined in the register. The problem pattern as exemplified in FIGS. 7 and 8 includes first line information containing odd pixel values of white and even pixel values of black and second line information containing odd pixel values of black and even pixel values of white. The pixel values of white are data in which all of the red (R) subpixel value, green (G) subpixel value, and blue (B) subpixel value are '1', and the pixel values of black are data in which all of the R subpixel value, G subpixel value, and B subpixel value are '0'. Here, '1' represents a high gray level value greater than a predetermined threshold value, and '0' represents a low gray level value less than the predetermined threshold value.

Figure 9:
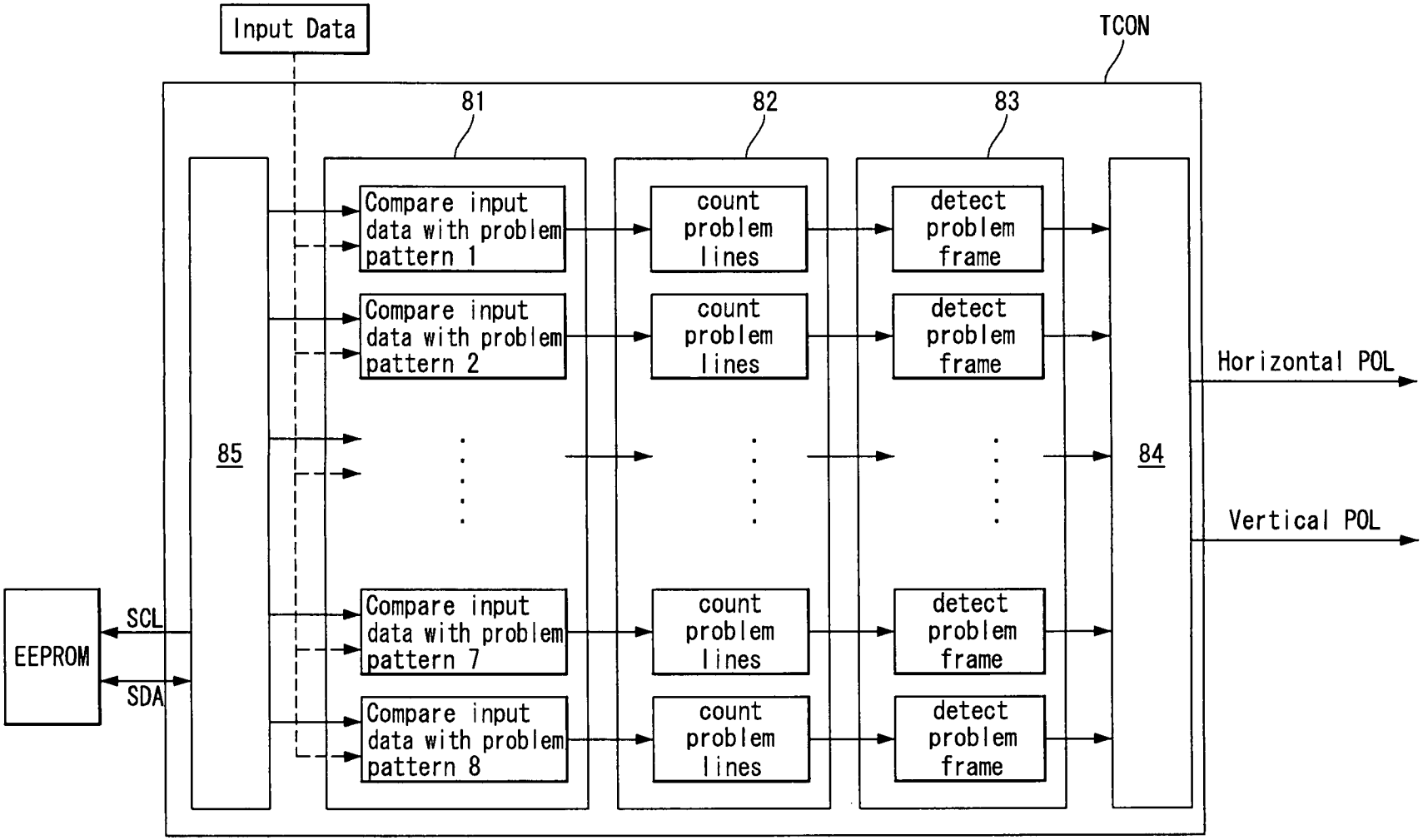
FIG. 9 is a block diagram showing a circuit block for recognizing a problem pattern image and generating polarity control signals in the timing controller according to the exemplary embodiment of the present invention.
Figure 12:
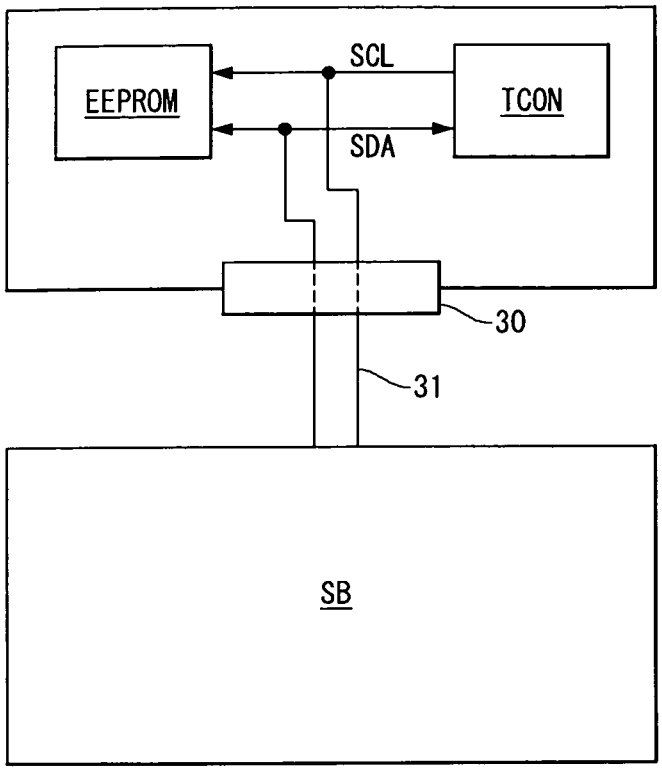
FIG. 12 is a view showing a circuit configuration capable of transmitting pixel information of a problem pattern and polarity pattern information to a control board from a system board.

The register for defining a problem pattern and a polarity pattern is embedded in the timing controller TCON. When the power of the liquid crystal display is turned on, the timing controller TCON loads problem pattern information and polarity pattern information from the EEPROM on an internal register through an I2C controller 85 as shown in FIG. 9. The I2C controller 85 transmits a serial clock SCL to the EEPROM and transmits the problem pattern information and the polarity pattern information in the form of serial data SDA to the I2C controller 85 in accordance with the serial clock SCL. The EEPROM is mounted on the system board SB or the timing controller TCON. The problem pattern information and the polarity pattern information may be stored through a ROM writer. The problem pattern information stored in the EEPROM may be modified, deleted, and added through the ROM writer. The system board SB may be connected to the I2C controller 85 of the timing controller TCON through a user cable 31 and a connector 30 as shown in FIG. 12. In this case, the I2C controller 85 is commonly connected to the EEPROM and the system board SB. The I2C controller 85 transmits a serial clock SCL to the EEPROM and the system board SB, and receives pixel information of a problem pattern and resultant polarity pattern information from the EEPROM or the system board SB. Accordingly, the system board SB or the control board CTRB may control the problem pattern recognition and polarity control signal output of the timing controller TCON by transmitting the problem pattern information and the polarity pattern information to the register of the timing controller TCON through I2C communication.

Figure 10:
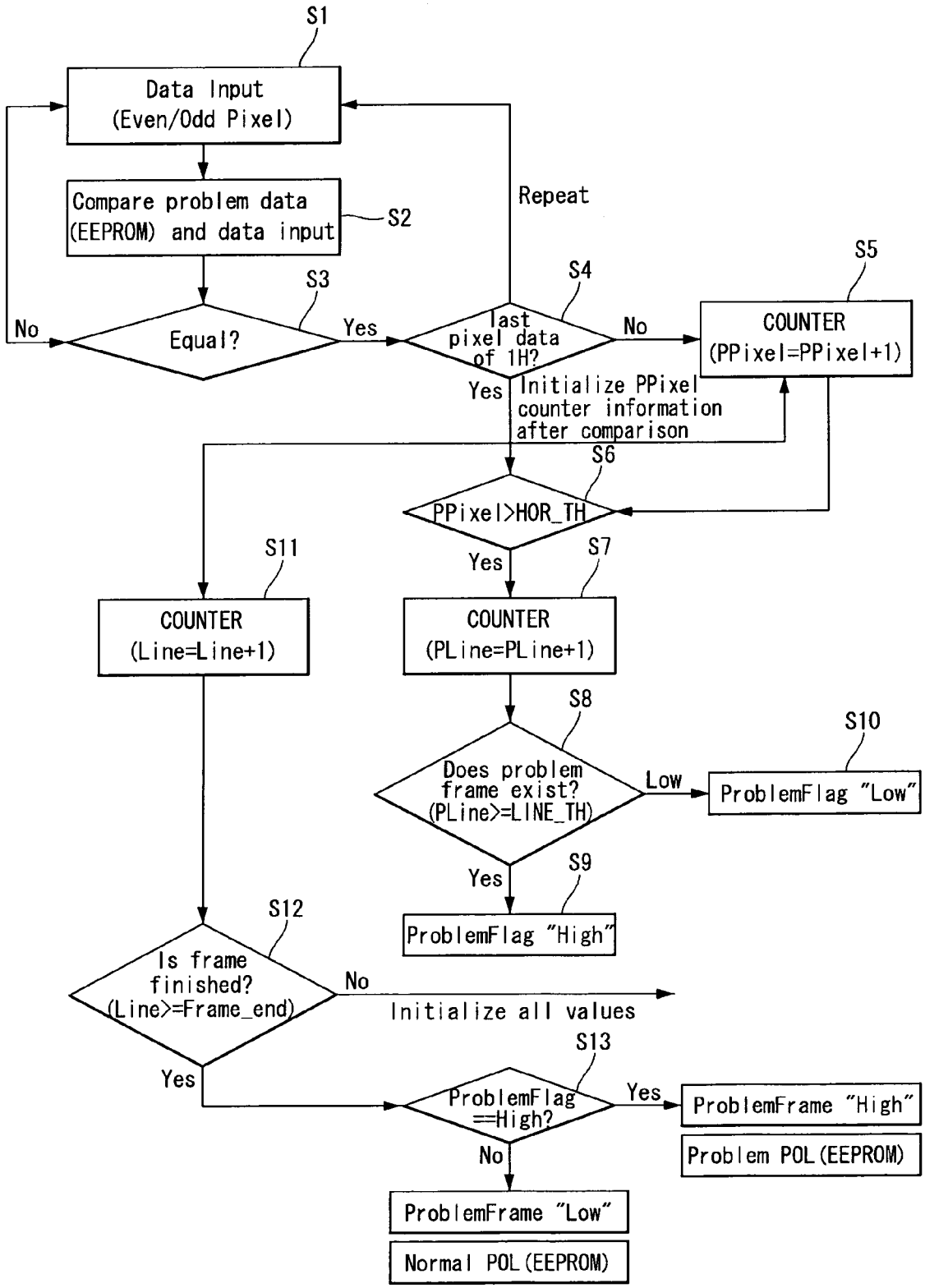
FIG. 10 is a flowchart showing step by step a problem pattern recognition procedure in the timing controller according to the exemplary embodiment of the present invention.

FIG. 9 is a block diagram showing a circuit portion for recognizing a problem pattern image and generating polarity control signals in the timing controller TCON. FIG. 10 is a flowchart showing step by step a problem pattern recognition procedure in the timing controller according to the exemplary embodiment of the present invention.

Referring to FIGS. 9 and 10, the timing controller TCON includes an I2C controller 85, a block pattern recognition unit 81, a line pattern recognition unit 82, a frame pattern recognition unit 83, and a polarity control signal generating unit 84.

The block pattern recognition unit 81 determines whether or not a problem pattern exists in input data in units of blocks by comparing the problem pattern defined in the register as shown in FIG. 3 with the input image every 2×2 pixel blocks. More concretely, the block pattern recognition unit 81 compares odd pixel data and even pixel data of consecutively input data with the first and second line information of the problem pattern read out from the register (S1 and S2). The pixel data of the input data includes RGB subpixels, and each of the RGB subpixels may be input as 8-bit data. When odd line data is input, the block pattern recognition unit 81 compares the most significant 1 bit or 2 bits of the input data with the subpixel values of the second line information defined in the register for every 8-bit input data to determine whether or not they are equal. When even line data is input, the block pattern recognition unit 81 compares the most significant 1 bit or 2 bits of the input data with the subpixel values of the second line information defined in the register for every 8-bit input data to determine whether or not they are equal. The block pattern recognition unit 81 increments a problem pixel count value PPixel by '1' each time input data and the problem pattern are identical (S3 to S5). The block pattern recognition unit 81 compares input data with the problem pattern defined in the register until the last pixel data of one line is reached by repeating the steps S1 to S5, compares the problem pattern count value PPixel accumulated in the input data of the one line with a first threshold value HOR_TH, initializes the problem pattern count value PPixel, and accumulates '1' to a line count value LINE (S4 to S6). The first threshold value HOR_TH is set to an integer greater than 2 and less than the number of pixels of one line, and may vary according to the resolution of the liquid crystal display panel.

If the count value PPixel accumulated in the one line is greater than the first threshold value HOR_TH in step S6, the line pattern recognition unit 82 determines the line as a problem line and increments a problem count value PLine by '1' each time a problem line is detected (S6 and S7). The frame pattern recognition unit 83 compares the problem line count value PLine with a second threshold value LINE_TH, and if the problem line count value PLine is greater than the second threshold value LINE_TH, determines the frame of the current input data as a problem frame and generates a problem frame flag ProblemFlag as a high logic (S8 and S9). On the other hand, if the problem line count value PLine is less than the second threshold value LINE_TH, the frame pattern recognition unit 83 determines the frame of the current input data as a frame having almost no problem pattern and generates a problem frame flag ProblemFlag as a low logic (S10). The second threshold value LINE_TH is set to an integer greater than 2 and less than a total number of the lines of the liquid crystal display panel. When the line count value LINE is equal to the number of lines of the liquid crystal display panel, the timing controller TCON initializes all of the count values (S11 and S12). When a problem frame flag ProblemFlag is input as the high logic, the polarity control signal generating unit 84 generates a vertical polarity control signal POL and a horizontal polarity control signal H1/H2DOT on the basis of the polarity pattern information read out from the register and controls the polarity of data voltages output from the source drive ICs 131 to 136.

Figure 11:
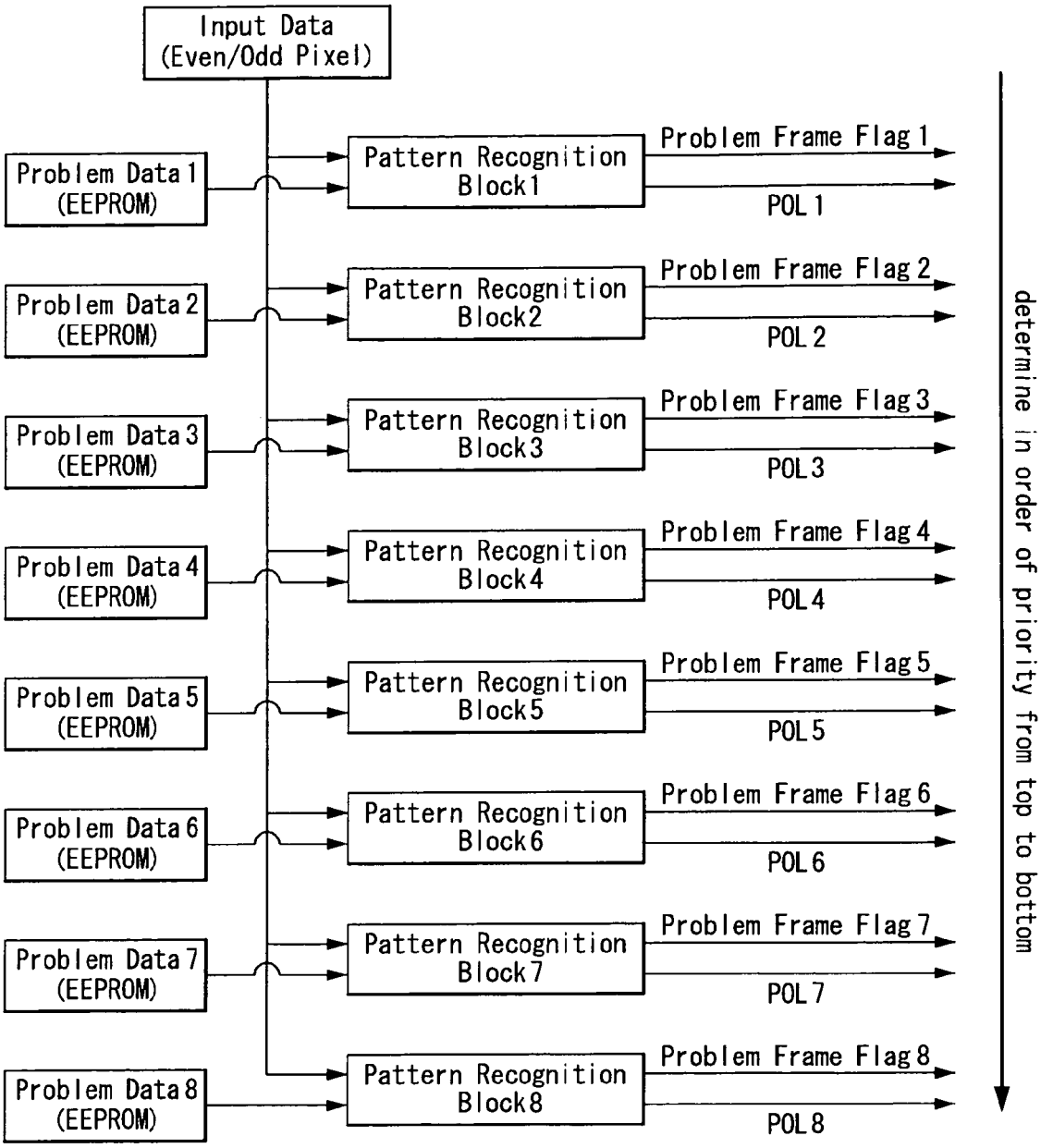
FIG. 11 is a view showing the priority order of polarity patterns.

The polarity pattern information may be set differently for every problem pattern stored in the register, and the input data may include a plurality of problem patterns. In this case, the polarity control signal generating unit 84 determines a polarity pattern by giving priority to a problem pattern with low ordinal number defined in the register as shown in FIG. 11. As a result of comparison of the input data with all of the problem patterns, if a problem frame flag ProblemFlag is generated as the low logic for all of the problem patterns, the polarity control signal generating unit 84 generates a vertical polarity control signal POL and a horizontal polarity control signal H1/H2DOT in a preset default polarity pattern.

In the liquid crystal display and method for driving the same according to the exemplary embodiment of the present invention, pixel information of a 2×2 problem pattern and resultant polarity pattern information are stored in a register, a problem frame including a plurality of problem patterns is detected by repetitively comparing pixel information of input data and pixel information of the problem pattern each time input data is input, and controls the polarity of data voltages to be supplied to the liquid crystal display panel on the basis of the polarity pattern information read out from the register. Therefore, the present invention enables it to select an optimum polarity pattern for any problem pattern by adjusting a register value, and requires no large-capacity memory, such as a line memory or frame memory, because a register for defining a problem pattern and a polarity pattern is used.

From the foregoing description, those skilled in the art will readily appreciate that various changes and modifications can be made without departing from the technical idea of the present invention. Therefore, the technical scope of the present invention is not limited to the contents described in the detailed description of the specification but defined by the appended claims.

What is claimed is:

1. A liquid crystal display, comprising:

a liquid crystal display panel including a plurality of data lines, a plurality of gate lines crossing the data lines, and a plurality of liquid crystal cells;

a register for storing pixel information of a problem pattern, the problem pattern of input data which degrades a display quality, and polarity pattern information associated with the problem pattern, wherein the problem pattern and the polarity pattern information stored in the register are capable of being modified, added, and deleted by being transmitted from either an EEPROM or a system board connected via a cable and a connector according to a model of the liquid crystal display;

a pattern recognition unit for comparing the input data with the problem pattern and counting a number of times whenever the input data is determined to be a problem and comparing an accumulated counted number with a first threshold value;

the pattern recognition unit comprising a block pattern recognition unit for comparing the input data with the problem pattern by comparing odd row pixel data and even row pixel data of consecutive input data with a first line and a second line information of the problem pattern from the register, respectively, and counting a number of times whenever the input data is determined to be a problem and comparing an accumulated counted number with a first threshold;

a line pattern recognition unit for determining a line as a problem line when the accumulated counted number of problems in the line is greater than the first threshold value;

a frame pattern recognition unit for comparing a number of problem lines with a second threshold value, and if the number of the problem lines is greater than the second threshold value, and determining a frame containing the number of problem lines as a problem frame;

a polarity control signal generating unit for generating a vertical polarity control signal and a horizontal polarity control signal in the problem frame on the basis of the polarity pattern information; and source drive integrated circuits (ICs) for controlling a vertical polarity and a horizontal polarity of data voltages supplied to the data lines in response to the vertical polarity control signal and the horizontal polarity control signal, wherein the register includes a first register, where bits b7 and b6 define vertical polarity control signal information, bits b5 to b0 define a first line information of the problem pattern, wherein the register includes a second register, where bit b7 defines the problem pattern ON/OFF, bit b6 defines horizontal polarity control signal information, bits b5 to b0 define a second line information of the problem pattern, wherein, when the problem pattern is defined as ON, a problem pattern is detected from a comparison of the problem pattern defined in a corresponding register with the input data, and wherein, when the problem pattern is defined as OFF, no comparison of the problem pattern defined in the corresponding register with the input data is made.

2. The liquid crystal display of claim 1, wherein the register further stores pixel information of a plurality of polarity patterns respectively associated with the plurality of problem patterns.

3. The liquid crystal display of claim 2, wherein the pixel information is transmitted to the register from the EEPROM through I2C communication.

4. The liquid crystal display of claim 2, wherein the pattern recognition unit detects the respective problem patterns from the input data.

5. The liquid crystal display of claim 4, wherein if the input data includes a plurality of problems based on a comparison with the plurality of problem patterns, the polarity control signal generating unit generates the vertical polarity control signal and horizontal polarity control signal on the basis of the polarity pattern information of a problem pattern with a higher priority according to a preset priority order of the plurality of problem patterns.

6. The liquid crystal display of claim 2, wherein the register stores a maximum of eight problem patterns and a number of bits per problem pattern is 8-bit×2 registers.

7. The liquid crystal display of claim 1, wherein the pattern recognition unit compares the input data with the problem pattern in units of pixel blocks.

8. The liquid crystal display of claim 7, wherein one unit of pixel blocks is 2×2.

9. A method for driving a liquid crystal display, comprising:

storing pixel information of a problem pattern, the problem pattern of input data which degrades a display quality, and polarity pattern information associated with the problem pattern, wherein the problem pattern and the polarity pattern information stored in the register are capable of being modified, added, and deleted by being transmitted from either an EEPROM or a system board connected via a user cable and a connector according to certain model of a liquid crystal display;

comparing input data with the problem pattern by comparing odd row pixel data and even row pixel data of consecutive input data with a first line and a second line information of the problem pattern from the register, respectively and counting a number of times the input data is determined to be a problem and comparing an accumulated counted number with a first threshold value;

determining a line is a problem line when the accumulated counted number for the line is greater than the first threshold value;

comparing a number of problem lines with a second threshold value, and if the number of problem lines is greater than the second threshold value, determining a frame containing the input data as a problem frame;

generating a vertical polarity control signal and a horizontal polarity control signal in the problem frame on a basis of the polarity pattern information; and controlling a vertical polarity and a horizontal polarity of data voltages supplied to data lines in response to the vertical polarity control signal and the horizontal polarity control signal, wherein the register includes a first register, where bits b7 and b6 define vertical polarity control signal information, bits b5 to b0 define a first line information of the problem pattern, wherein the register includes a second register, where bit b7 defines the problem pattern ON/OFF, bit b6 defines horizontal polarity control signal information, bits b5 to b0 define a second line information of the problem pattern, wherein, when the problem pattern is defined as ON, a problem pattern is detected from a comparison of the problem pattern defined in a corresponding register with the input data, and wherein, when the problem pattern is defined as OFF, no comparison of the problem pattern defined in the corresponding register with the input data is made.

10. The method of claim 9, wherein, the storing of pixel information includes pixel information of a plurality of polarity patterns respectively associated with the problem patterns.

11. The method of claim 10, wherein the pixel information is transmitted to the register from the EEPROM through I2C communication.

12. The method of claim 10, further comprising:

generating a vertical control signal and a horizontal control signal in a preset polarity pattern if a problem frame is not determined.

13. The method of claim 10, wherein the comparing input data with the problem pattern is performed in units of pixel blocks.

14. The method of claim 13, wherein one unit of pixel blocks is 2×2.

15. The method of claim 9, wherein, if the input data includes a plurality of problems based on a comparison with the plurality of problem patterns, the vertical polarity control signal and the horizontal polarity control signal are generated on the basis of the polarity pattern information of a problem pattern with a higher priority according to a preset priority order of the plurality of problem patterns.

* * * * *